United States Patent [19]

Branson

[11] Patent Number: 5,059,033

[45] **Date of Patent: * Oct. 22, 1991**

[54] DETACHABLE HANDLE FOR SHIPPING SACKS

[75] Inventor: Mark E. Branson, Shelbyville, Ind.

[73] Assignee: KCL Corporation, Shelbyville, Ind.

[ * ] Notice: The portion of the term of this patent subsequent to Feb. 20, 2007 has been disclaimed.

[21] Appl. No.: 450,948

[22] Filed: Dec. 15, 1989

Related U.S. Application Data

[63] Continuation-in-part of Ser. No. 334,696, Apr. 6, 1989, Pat. No. 4,902,140.

[51] Int. Cl.[5] ..... B65D 33/06; B65D 33/16

[52] U.S. Cl. ..... 383/13; 383/9; 383/14; 383/25; 383/79

[58] Field of Search ..... 383/9, 13, 25, 14, 79

[56] References Cited

U.S. PATENT DOCUMENTS

| | | | |
|---|---|---|---|
| 2,947,464 | 8/1960 | Newton | 383/9 |
| 3,462,069 | 8/1969 | Suominen | 383/9 |
| 4,241,865 | 12/1980 | Ferrell | 383/79 |
| 4,730,943 | 3/1988 | Johnson | 383/25 |
| 4,902,140 | 2/1990 | Branson | 383/25 |

FOREIGN PATENT DOCUMENTS

| | | | |
|---|---|---|---|
| 542114 | 6/1957 | Canada | 383/14 |
| 2480243 | 10/1981 | France | 383/14 |

*Primary Examiner*—Stephen P. Garbe
*Attorney, Agent, or Firm*—Woodard, Emhardt, Naughton Moriarty & McNett

[57] ABSTRACT

A shipping sack having side walls defining a mouth from which contents may be discharged, includes a non-reclosable stitched fastener across and closing the mouth. The stitched fastener includes a removable chain stitch and a removable rip tape for facilitating manual opening of the stitched fastener. The rip tape in one embodiment is composed of a strip having a cut-out opening therethrough defining a handle adapted to be manually grasped for carrying the shipping sack. The rip tape also includes a free end extending beyond the edge of the shipping sack to facilitate manual access to the rip tape and to facilitate pulling the rip tape to remove the stitched fastener. In another embodiment, the handle rip tape includes a continuous row of finger holes in lieu of the single cut-out opening.

5 Claims, 3 Drawing Sheets

DETACHABLE HANDLE FOR SHIPPING SACKS

BACKGROUND OF THE INVENTION

The present application is a continuation-in-part of co-pending application Ser. No. 334,696, filed on Apr. 6, 1989 now U.S. Pat. No. 4,902,140 by the same inventor and assigned to the same assignee.

This invention relates to the art of shipping sacks, and more particularly to sacks having a non-reclosable closure fastener and a handle for carrying the sack.

Shipping sacks are frequently used for carrying heavy, bulky goods, such as dog food, charcoal, cat litter and detergent, which ordinarily require packaging which will withstand in excess of fifteen pounds contents weight. For this type of goods, the sacks are frequently provided with a carrying handle at the top of the sack to facilitate carrying the full sack. One type of sack known in the art includes a separate rigid plastic handle that is sewn onto the top of the sack with a non-reclosable, separable closure fastener, such as a chain stitch, that is used to close the top of the sack. One difficulty with handles of this type is that the separate plastic handle is usually hand fed and supported during the operation in which the chain stitch is sewn onto the sack. Not only is this type of operation labor intensive, it is also inaccurate, resulting in handles that are not completely attached to the sack.

SUMMARY OF THE INVENTION

A primary aim of the present invention is to overcome the disadvantages and inefficiencies of the prior handles attached to shipping sacks for bulky products. An important object of the invention is to provide a new and improved detachable handle for the shipping sacks that is readily and easily attached to the sack with the non-reclosable, separable closure fastener. Another object of the invention is to provide a detachable handle for shipping sacks that can be attached to the shipping sack in a continuous operation, requiring little or no manual intervention.

These and other objects of the invention are addressed by the provision of a rip tape that extends across the width of the shipping sack to which the tape is to be attached. The rip tape includes an upper peripheral attachment portion that is sewn together with the upper ends of the walls of the shipping sack. The rip tape also includes a handle cut-out opening beneath the peripheral attachment portion that is adapted to be manually grasped. The rip tape not only provides a means for carrying the filled shipping sack, it also is usable as a tear-strip to facilitate the removal of the non-reclosable, separable closure fastener, thereby providing access to the contents of the shipping sack.

In another aspect of the invention, the handle rip tape is formed from a continuous strip of tape having spaced apart finger holes. The finger holes are sized to receive the fingers of the hand for carrying the shipping sack. The presence of the spaced apart finger holes eliminates the need for centering the handle on the shipping sack, since the finger holes extend continuously across the sack. Other features, objects and advantages of the invention will be readily apparent from the following description and accompanying figures.

Figure 2:
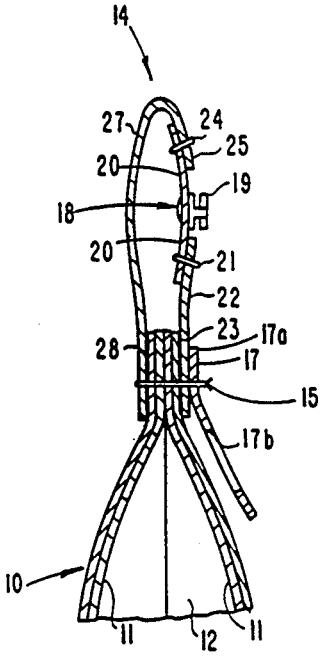
FIG. 2 is an enlarged fragmentary sectional view taken along line 2-2 of FIG. 1.

FIG. *2a* is an enlarged fragmentary sectional of the shipping sack of FIG. 2 shown with the rip tape provided as a carrying handle.

Figure 3:
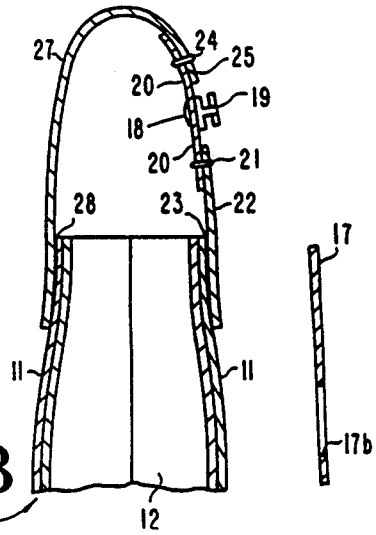

FIG. 3 is a fragmentary sectional view showing the stitched fastener opened and the detachable handle removed.

Figure 4:
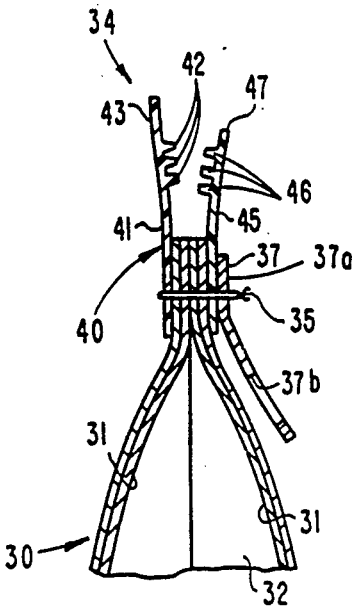

FIG. 4 is an enlarged fragmentary sectional view similar to the view of FIG. 2, but showing a different secondary reclosable closure fastener.

Figure 5:
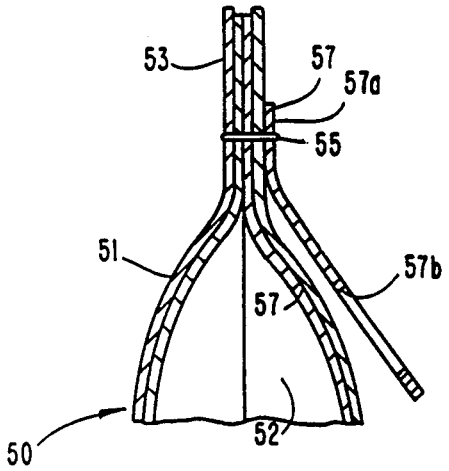

FIG. 5 is an enlarged sectional view similar to FIG. 2, but showing a shipping sack having no secondary reclosable closure fastener.

Figure 6:
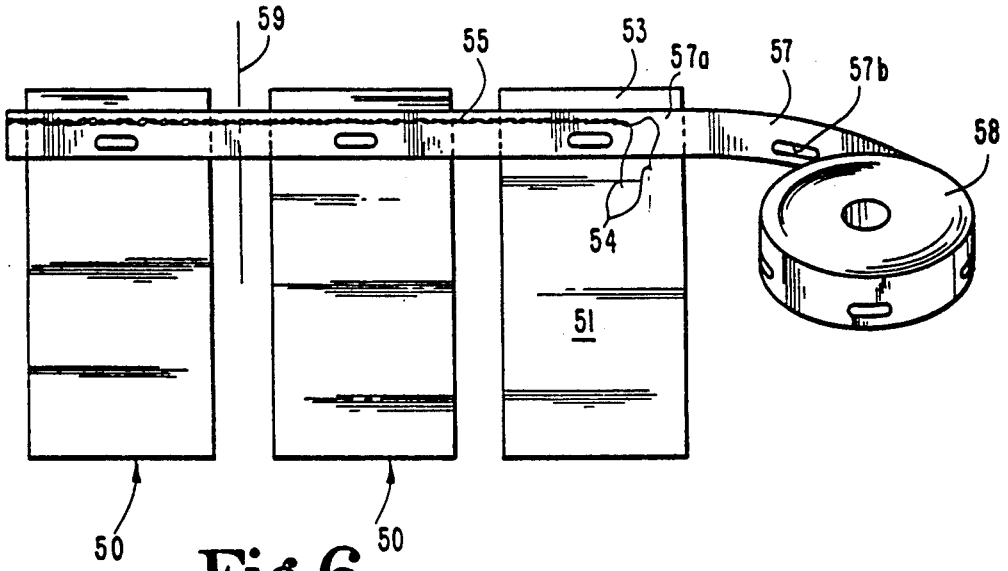

FIG. 6 is a schematic illustration of steps in the method of making the shipping sack of the present invention having the detachable rip tape, in which the shipping sack is similar to that shown in FIG. 5.

Figure 7:
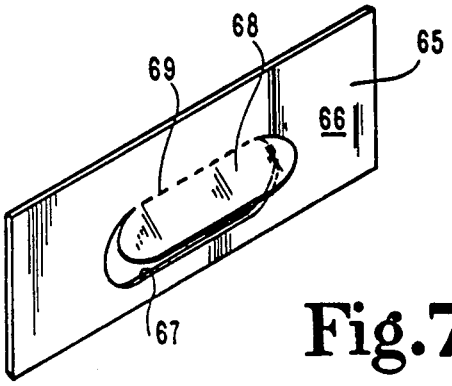

FIG. 7 is an enlarged perspective view of a detachable handle of the present invention.

Figure 8:
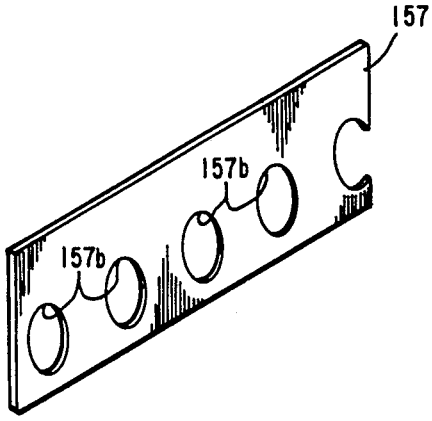

FIG. 8 is an enlarged perspective view of a detachable handle of an alternative embodiment of the present invention.

Figure 9:
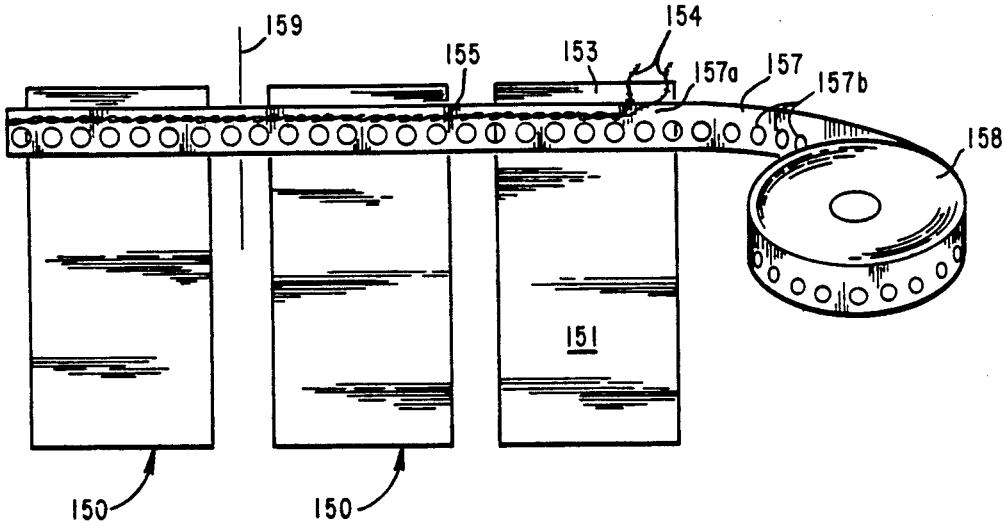

FIG. 9 is a schematic illustration of steps in the method of making the shipping sack having a detachable handle according to the alternative embodiment of FIG. 8

DESCRIPTION OF THE PREFERRED EMBODIMENTS

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A shipping sack 10 of customary design comprises front and back face walls 11 with opposite sidewalls 12 and a fixed bottom closure 13 for sealing the bottom edge of the walls 11. The bottom closure 13 may comprise any typical structure, such as the ends of the back walls 11 turned over and adhesively secured, a folded closure strip adhesively secured or stitched in place, or the like. It is understood that sacks of this kind are generally closed at their upper ends, and the lower ends of the sacks remain open until the sacks are filled through the opened lower ends, which are then closed to seal the contents within the sack.

The sack 10 includes a top closure 14 which, in the preferred embodiment, includes a non-reclosable, separable fastener 15 and a secondary reclosable fastener 18. In one embodiment of the invention, the secondary reclosable fastener 18 comprises a zipper assembly 19 that is carried on a zipper tape 20, as illustrated in FIG. 2. The zipper tape 20 is secured, such as by double chain stitching 21 and 24, to a pair of strips 22 and 27. The bottom ends of the strips 22 and 27 are secured to the walls 11 of the sack by means of adhesive 23 and 28. The secondary reclosable zipper fastener 18 of the present embodiment is identical in its construction and operation to the fastener disclosed in the patent to Ferrell, U.S. Pat. No. 4,241,865, assigned to the assignee of the present application, the subject matter of which is incorporated herein by reference.

The non-reclosable fastener 15 consists of a separable stitched fastener or chain stitch. The chain stitch of the stitched fastener 15 is stitched across and closes the upper end or mouth of the sack 10. The chain stitch 15 is adapted to be removed or unraveled by pulling the ends 15*a* of the chain stitch. However, the chain stitch is sufficiently strong to keep the mouth of the sack sealed, even when the contents of the sack are shifted during handling.

Figure 2A:
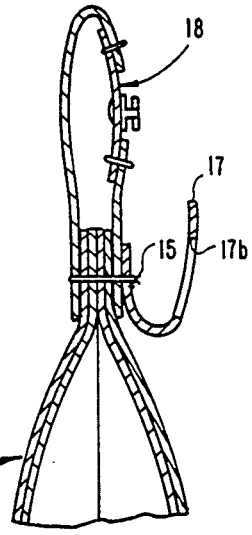

In order to facilitate the removal of the non-reclosable, separable fastener 15, a rip tape or tear-strip 17 is provided. The rip tape 17 is stitched onto the wall 11 of the sack by means of the chain stitch 15. The rip tape 17 is used to facilitate removal of the chain stitching by providing a wider strip to grasp and pull. In the prior art, the rip tape has typically been a uniform strip composed of crepe paper. In a novel deviation from the prior art, the present invention provides an upper peripheral attachment portion 17*a*, through which the chain stitch fastener 15 is sewn, and a cut-out opening 17*b* defining a handle below the chain stitch fastener. The handle cut-out opening 17*b* is configured to provide a manual hand-hold formed in the rip tape 17 to facilitate carrying the shipping sack 10. In its use as a handle, the rip tape 17 is bent upwards over the chain stitch 15, as shown in FIG. 2*a*. Alternatively the rip tape 17 can be stitched to the sack 10 with the handle opening 17*b* above the chain stitch as opposed to the orientation shown in FIG. 2 with the opening 17*b* below the chain stitch.

Figure 1:
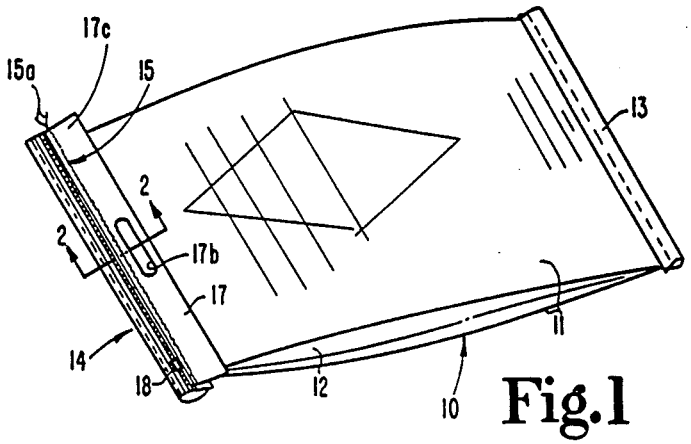
FIG. 1 is a perspective view of a shipping sack embodying the invention.

The rip tape may comprise a wider strip so that the handle cut-out opening extends above the secondary closure fastener. In this instance, a second tip tape may be provided at the other of the sack walls 11 so that the handles overlap the top of the sack 10. The rip tape also includes a free end portion 17*c* which extends slightly beyond the side edges of the sack walls 11, as shown in FIG. 1. This free end portion 17*c* is readily accessible and easy to grasp for pulling the rip tape to separate or unravel the chain stitch.

As shown in FIG. 3, the mouth of the shipping sack 10 is opened when the non-reclosable, separable chain stitch fastener 15 is removed. At the same time, the chain stitch is removed, the rip tape 17 including the handle 17*b* is also removed and may be discarded by the consumer, since the handle is no longer necessary for transporting the product from the point of sale to the comsumer's home. Thus, it is seen that the rip tape 17 serves two functions—one as a means for facilitating removal of the chain stitch fastener 15 and another as means for transporting the sack when filled with a product.

Alternative embodiments of the present invention are shown in FIGS. 4 and 5. In FIG. 4, a shipping sack 30 includes a top closure 34 having the non-reclosable chain stitch fastener 35 and a secondary reclosable fastener 40, each attached across and closing the upper end of the sack 30. The secondary reclosable fastener 40 includes a pair of opposing profile strips 41 and 45. Each of the profile strips includes a number of interlocking ribs 42 and 46, respectively. The profile strips 41 and 45 also include a pair of flanges 43 and 47 at the top of the respective strips to facilitate separation of the interlocking ribs. The profile fastener strips of the embodiment of FIG. 4 is the subject of a co-pending application assigned to the assignee of the present invention. In this embodiment, a handle rip tape 37 is removably attached to the sack 30 at its upper attachment peripheral portion 37*a* by the chain stitching 35. The handle cut-out opening 37*b* extends below the chain stitching, but can be folded upwards to facilitate carrying the shipping sack as with the previous embodiment.

In the embodiment of FIG. 5, a shipping sack 50 includes an upper peripheral portion 53 where the sack walls 51 are joined only by the non-reclosable stitched fastener 55. A handle rip tape 57 is sewn onto the sack 50 by way of the chain stitching 55 at the upper peripheral attachment portion 57*a* of the tape. The handle cut-out opening 57*b* extends below the chain stitching in the manner described above.

The rip tape handle of the present invention overcomes a primary difficulty with the rigid plastic handles of the prior art in that the handle rip tape may be attached to the shipping sack in a continuous process with almost no human intervention. In the method of manufacturing the shipping sack of the present invention, a succession of tubular collapsed, flattened sacks, such as the sack 50 shown in the embodiment of FIG. 5, is moved along a production line with the sacks aligned in a parallel spaced apart relation, substantially as shown in FIG. 6. The handle rip tape 57 is continuously supplied from a reel 58. Cord or thread 54 is provided from a separate spool source (not shown) and is continuously sewn by conventional means into the chain stitch 55 onto one wall 51 at the open end of the sack. The sacks proceed to a cutting station in which the handle rip tap 57 is severed along line 59 between adjacent sacks. With the non-reclosable fastener in place, the sacks 50 are then ready to be filled with product and to have the bottom edges of the sack walls 51 sealed.

Although the method shown in FIG. 6 includes the application of the handle rip tape 57 and chain stitch 55 alone, a separate reel may be provided which includes a secondary reclosable fastener, such as the zipper-type fastener 18 of the embodiment of FIGS. 1–3, or the profile strip-type fastener 40 of the embodiment of FIG. 4. These particular secondary reclosable fasteners may be applied in the same manner described and illustrated in the Ferrell U.S. Pat. No. 4,241,865, referenced an incorporated above.

The handle rip tape 57 is preferably formed in a continuous process in which a single strip of material is passed through a stamping operation to stamp the handle openings therethrough at spaced intervals coinciding with the spacing between adjacent sacks in the continuous process described above. The rip tape is preferably composed of a flexible plastic that can be die punched or stamped to form the handle cut-out opening and sewn onto the sack, yet remain sufficiently strong and tear resistant to allow its use as a carrying handle. In one version of the handle rip tape, a tape 65, shown in FIG. 7, includes an upper peripheral attachment portion 66 and a handle cut-out opening 67. The cut-out opening 67 is not completely closed, that is a flap 68 remains which is, in effect, hingedly attached to the remainder of the handle rip tape along line 69.

Other variations in the design and configuration of the handle cut-out opening 67 or in the handle rip tape 65 itself, are contemplated by the invention. For instance, the handle may be formed by an overlapped layer of plastic that is sealed along one edge to form a closed loop. The handle rip tape may also be formed of a strong crepe paper or cloth-type material that can be readily sewn and attached to a shipping sack by a chain stitch fastener, and that is sufficiently strong to carry the weight of a full shipping sack. The handle rip tape must also be sufficiently to avoid tearing when the handle rip tape is used to separate or unravel the chain stitch fastener.

An alternative embodiment of the handle rip tape for use in the present invention is illustrated in FIG. 8. The handle rip tape 157 includes a plurality of finger holes 157*b* at spaced intervals along the length of the handle rip tape. The finger holes 157*b* are sized to receive the fingers of the user to facilitate carrying the shipping sack to which the handle rip tape is attached. The handle 157 is similar in all other respects to the handle 57 of the previous embodiment and can be formed of plastic, crepe paper of cloth material as previously described.

An important advantage of this configuration of handle rip tape 157 is appreciated on reference to FIG. 9 schematically illustrating the manner of applying the rip tape 157 to a sack 150. In steps of the method of attaching rip tape 157 are identical to the steps described for the previous embodiment as illustrated in FIG. 6. For instance, an upper attachment portion 157*a* of the rip tape 157 is attached to the sack wall 151 by a non-reclosable stitched fastener in the manner described more fully above. Likewise, the rip tape is payed from a reel 158 and separated after attachment to a a number of continuously fed shipping sacks 150 along a cut-line 159 between adjacent sacks.

However, unlike the single opening handle rip tape 57 of the previous embodiment, the presence of a plurality of spaced apart finger holes 157*b* eliminates the need for axact lateral registry of the handle rip tape and grasping opening with the width of the shipping sack. Whereas in the former embodiment the opening 57*b* of the rip tape 57 was generally centered over each sack 50, the multiple finger openings 157*b* of the handle rip tape 157 ensures that an adequate number of finger openings will be centrally located relative to the shipping sack. In addition, the plurality of available finger holes 157*b* corresponding to each sack 150 insures that user will always be able to find a number of finger holes to grasp for carrying the heavy sack in a stable manner. The continuous row of spaced apart finger holes not only facilitates the manufacturing of shipping sacks with detachable handles, it also facilitates the use of the handle by the consumer.

In the illustrated embodiments, the rip tapes 57 and 157 are depicted as being payed from respective reels 58 an 158 with the handle openings (57*b* and 157*b*, respectively) already formed therethrough. Alternatively, the reels 58 and 158 can include a continuous strip of material that is fed to a punching station just prior to mating the rip tape with the sack. The punching station would be operable to punch the handle opening into the strip as it is payed from the reel 58 or 158.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A shipping sack having side walls defining a mouth through which the contents of the sack may be removed, comprising:

a non-reclosable stitched separable closure fastener across and closing the mouth of the sack andd adapted for manual separation to remove said stitched fastener and open the mouth of the sack; and a rip tape for facilitating removal of said stitched fastener, said rip tape being removably joined to the sack by said stitched fastener and including a plurality of spaced apart holes therethrough sized for receiving the fingers of a user and manually graspable to carry the sack when said rip tape is joined to the sack;

said rip tape having a manually accessible free end which is adapted to be manually pulled to remove said rip tape, whereby said stitched fastener is separated from the shipping sack as said rip tape is removed.

2. The shipping sack of claim 1, wherein said stitched fastener includes a chain stitch passing through said rip tape and through the side walls of the sack.

3. The shipping sack of claim 1, wherein:

said rip tape is cut from a continuous strip; and said free end of said rip tape extends slightly beyond an edge of the side walls of the sack to facilitate manual access to said free end.

4. The shipping sack of claim 1, further comprising secondary reclosable closure means secured to the sack across the mouth of the sack outboard of and apart from said stitched fastener, for closing the mouth after opening of said stitched fastener.

5. The shipping sack of claim 1, wherein said plurality of holes in said rip tape includes a sufficient number of holes to extend entirely across the width of the shipping sack.

* * * * *